US005100059A

United States Patent [19]

Englhard et al.

[11] Patent Number: 5,100,059

[45] Date of Patent: Mar. 31, 1992

[54] SINGLE VALVE ASPIRATION TYPE SPRAYER

[75] Inventors: Ronald F. Englhard, Mission Viejo; Donald J. Shanklin, Fullerton, both of Calif.

[73] Assignee: Hayes Products, Santa Fe Springs, Calif.

[21] Appl. No.: 671,259

[22] Filed: Mar. 18, 1991

[51] Int. Cl.[5] ..... B05B 7/26; B05B 7/30

[52] U.S. Cl. ..... 239/310; 239/318; 222/484

[58] Field of Search ..... 239/310, 318, 414; 222/630, 637, 129.2, 484

[56] References Cited

U.S. PATENT DOCUMENTS

| | | | |
|---|---|---|---|
| 3,770,205 | 11/1973 | Proctor et al. | 239/318 |
| 4,583,688 | 4/1986 | Crapser | 239/318 |
| 4,653,691 | 3/1987 | Grime | 239/318 |
| 4,750,674 | 6/1988 | Chow et al. | 239/318 |
| 4,767,058 | 8/1988 | La Rosa et al. | 239/318 |
| 5,007,588 | 4/1991 | Chow et al. | 239/310 |

*Primary Examiner*—Andres Kashnikow
*Assistant Examiner*—Lesley D. Morris
*Attorney, Agent, or Firm*—Harold L. Jackson

[57] ABSTRACT

An aspiration type chemical sprayer for dispensing small quantities of a liquid based chemical into a stream of carrier fluid is disclosed. The sprayer includes a sprayer head assembly sealingly mounted onto a container holding chemicals such as pesticides or fertilizers. A unitary valve in the sprayer head assembly control carrier fluid flow from a pressurized source of water while simultaneously providing a controlled aspiration rate and full communication of the container interior to atmospheric pressure. The valve additionally includes simultaneous closure of the carrier fluid, aspiration and vent passageways so as to seal the chemical in the container when the sprayer is not being used.

16 Claims, 4 Drawing Sheets

SINGLE VALVE ASPIRATION TYPE SPRAYER

BACKGROUND OF THE INVENTION

1. Field of the Invention

The invention relates generally to mixing and dispensing sprayers and more particularly to aspiration type sprayer for use in dispensing small quantities of a liquid based chemical into a relatively large quantity of a carrier fluid.

2. Description of Related Art

Every year thousands of gallons of chemicals such as fertilizers or pesticides are applied to crops, plants, lawns, flowers, vegetable gardens and other organic type vegetation. Such chemicals are sold to the consumer in concentrated form and therefore are extremely hazardous to the consumer end user and environment in general. Accordingly, these hazardous chemicals preferably are marketed in containers with a sprayer head permanently attached thereto so as to minimize accidental exposure to the consumer, such as from careless handling. Furthermore, a tamper proof container arrangement is needed to prevent unauthorized access by children whose curiosity sometimes gets the better of them. To make such nonrefillable products economically feasible, it is necessary to provide a sprayer which is of sufficiently low cost to allow the bottle and sprayer arrangement to be discarded when the container contents have been all used up. In order to be commercially accepted such a sprayer must be inexpensive to manufacture and yet operate reliably and safely provide a desired mixing ratio to meet the particular requirements of the individual user.

Several aspiration type sprayers have evolved over the hears, but have met with certain disadvantages that make them undesirable. For example, U.S. Pat. No. 4,750,674 issued to Chow et al., discloses a sprayer having a system of air vent and aspiration openings of different sizes to obtain a selection of discrete mixing ratios. The mechanism requires a system of cups to block openings associated with nonselected aspiration rates and to provide the desired fluid communication. Such a system, however, requires the alignment and assembly of a plurality of elements including openings, cup seal and springs. Such a system is complicated to manufacture and assemble and therefore is undesirably expensive. Further, such devices fail to provide a simplified sprayer with a minimum of parts that are of simple design to promote reliability.

Other conventional sprayers, such as that described in U.S. Pat. No. 3,186,643 issued to George et al. use a rotating carrier fluid valve having a range of adjustability of carrier fluid flow in combination with a vent bore closure boss extending from the rotating valve. George et al's. sprayer arrangement, however, like other conventional sprayers disadvantageously has many parts which makes it an undesirable alternative for a low cost disposable type sprayer.

An improved aspiration-type sprayer is disclosed in a co-pending patent application Ser. No. 468,845, filed Jan. 23, 1990 now U.S. Pat. No. 5,039,016 for Aspiration-Type Chemical Sprayer also assigned to the assignee of the present invention which includes a sprayer head assembly sealingly mounted onto a container for storing a chemical to be dispensed. The sprayer head includes a multi-function unitary valve providing an aspiration opening simultaneously with full communication of the container interior to atmospheric pressure.

The valve may include means for positive and simultaneous closure of the aspiration and vent passages so as to seal the chemical in the container when the sprayer is not in use. The sprayer assembly is coupled to a source of pressurized carrier fluid such as a garden hose. The carrier fluid is controlled by a control valve which blocks the flow of water from the hose when the sprayer is not in use. While this sprayer is of simple construction, two valves typically are employed. It would be an advancement to the art to have a sprayer arrangement that includes only one valve to control aspiration, venting and carrier fluid flow in a simple yet reliable construction.

SUMMARY OF THE INVENTION

It is therefore an object of the invention to provide an aspiration type chemical sprayer which includes a minimum number of components that are relatively easy to manufacture and assembly.

It is another object of the invention to provide an aspiration type chemical sprayer with a unitary multifunction valve controlling aspiration, venting and carrier fluid flow.

It is an advantage of the invention that the single valve aspiration-type chemical sprayer can be held by one hand while simultaneously being operated by the other hand.

A single valve aspiration type sprayer according to the present invention includes a sprayer head assembly that is attached to a container for storing chemicals therein. A hose may be connected to the sprayer head assembly to provide the necessary carrier fluid, which typically is water. The sprayer head assembly has a valve rotatably positioned therein simultaneously intersecting three passageways: an aspiration passageway, a vent passageway and a carrier fluid passageways. In closed position, the three passageway are blocked by the valve. However, in the open position, the valve has formed integrally therethrough three holes which provide simultaneous registry for the aspiration passageway, vent passageway and carrier fluid passageway.

Other and further objects, advantages and characteristic features of the present invention will become readily apparent from the following detailed description of a preferred embodiment of the invention when taken in conjunction with the accompanying drawings.

DESCRIPTION OF PREFERRED EMBODIMENTS

Figure 6:
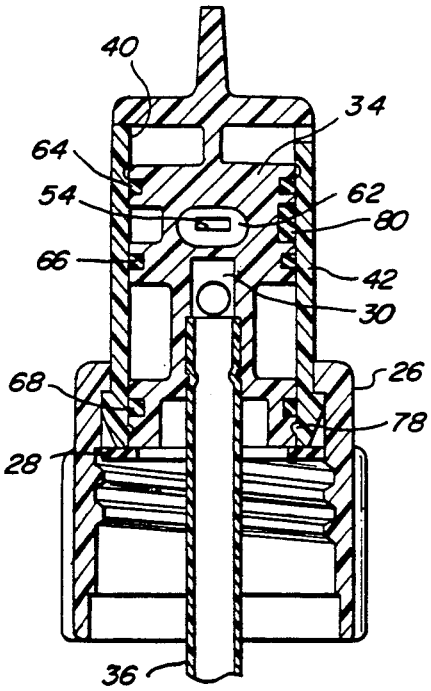
FIG. 6 is a sectional view taken along line 6—6 of FIG. 4.
Figure 8:
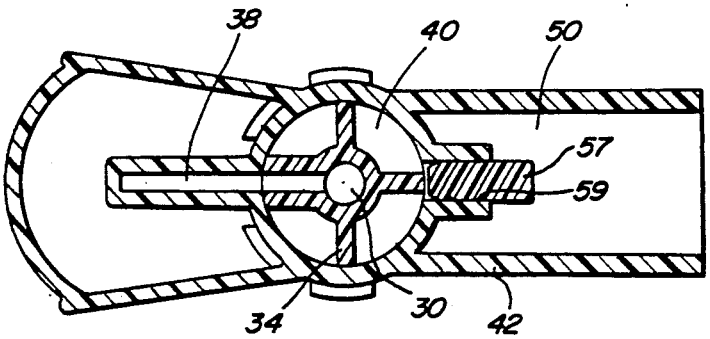
FIG. 8 is a sectional view taken along line 8—8 of FIG. 4.
Figure 9:
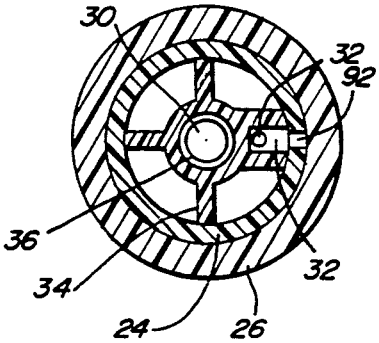
FIG. 9 is a sectional view taken along line 9—9 of FIG. 4.

Referring now with more particularity to the drawings, wherein like or similar parts are designated by the same numerals throughout the various figures, a sprayer head assembly 20 is illustrated in FIGS. 1–4 which sealingly is secured to the mouth of a chemical container 22. The connection between the sprayer head assembly 20 and container 22 can be achieved by providing the depending sprayer neck portion 24 with a conventional rotatable coupler 26 including washer 28, the rotatable coupler having internal threads which cooperatively receive corresponding threads surrounding the mouth of a container bottle, such as container 22. To make the sprayer head assembly 20 nonremovable from the container neck, the sprayer neck may include inwardly projecting lugs which oppose cooperating lugs (not shown) formed on the container, thereby preventing removal of the sprayer head assembly following installation onto a chemically filled container. When installed to the sprayer head assembly 20, the mouth of container 22 is in communication with upstream aspiration duct 30 and upstream vent duct 32 and opening 33 in rotatable valve 34 and otherwise closed upper interior of neck, see also FIGS. 6 and 8–9. The aspiration duct 30 communicates with a downwardly depending chemical flow or dip tube 36 which extends into container 22 terminating proximate the bottom thereof. A downstream aspiration passageway 38 formed in sprayer head 42 also communicates with the interior of cylindrical bore 40. The downstream aspiration passageway 38 communicates with aspiration orifice 43 which terminates into graduated recess 44 formed on upwardly inclined wall 46 of sprayer head 42.

Figure 7:
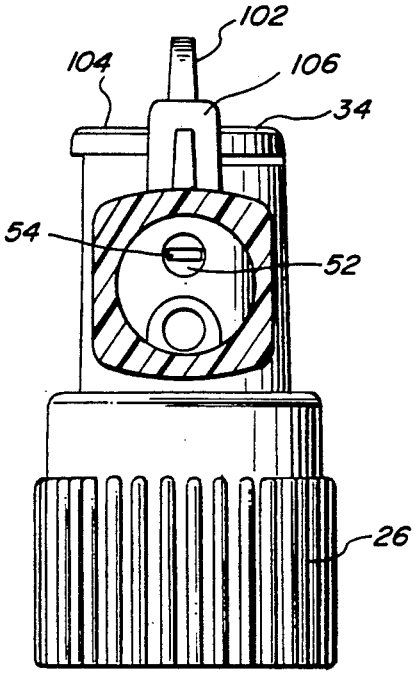
FIG. 7 is a sectional view taken along line 7—7 of FIG. 1.

The sprayer head assembly 20 includes an inlet fluid carrier means which comprises an input chamber 50 and first constricted fluid carrier hole 52, second constricted carrier fluid hole 54, and hooded or expansion chamber 56 serving as the outlet. The upstream end of inlet fluid carrier means includes a conventional rotatable coupler 58 including washer 60, for threaded sealing engagement between input chamber 50 and a source of pressurized carrier fluid, such as a garden hose (not shown), for example. The carrier fluid is received in input chamber 50 and controlled through first constricted hole 52 by means of rotatable valve 34 which has a carrier fluid duct 62 traversely therethrough. The rotatable valve 34 may be rotated to align carrier fluid duct 62 with first and second constricted holes 52 and 54 for discharge of carrier fluid into hooded chamber 56. Second constricted hole 54 preferably has an elongated rectangular cross-sectional shape as shown more particularly in FIGS. 6 and 7, which aids in spreading the carrier fluid as it enters the hooded chamber 56.

Figure 10:
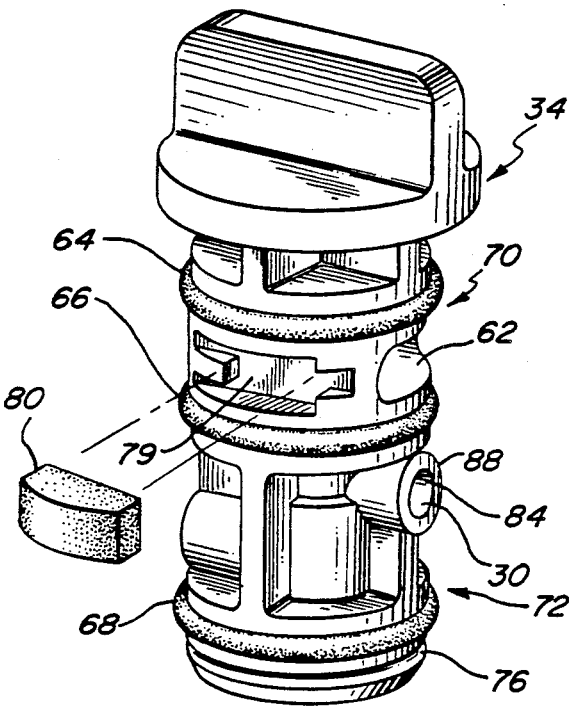
FIG. 10 is a perspective view of a control valve according to the principles of the invention.
Figure 11:
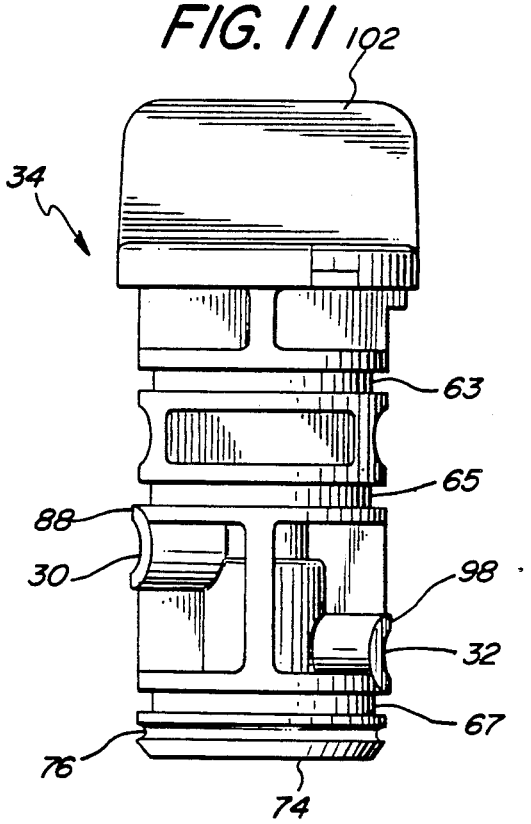
FIG. 11 is an elevational view of the control valve of FIG. 10.
Figure 12:
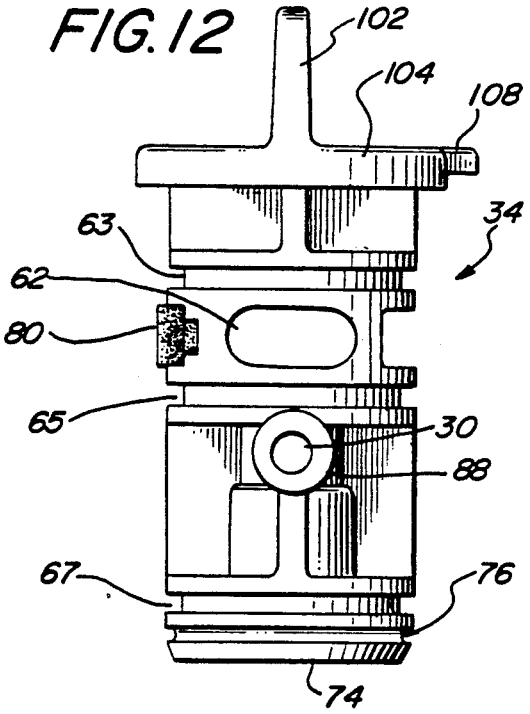
FIG. 12 is another elevational view from a different side of the control valve of FIG. 10.
Figure 13:
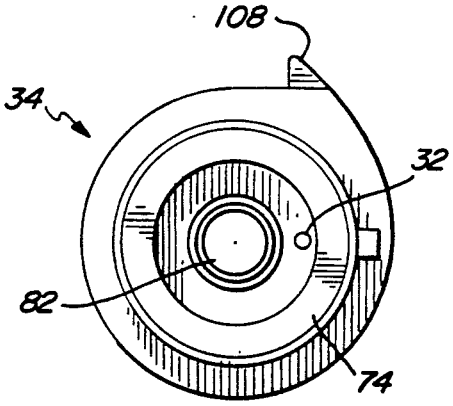
FIG. 13 is a bottom view of the aspiration control valve of FIG. 10.

Rotatable valve 34 also controls communication of vent duct 32 with atmospheric pressure and communication of downstream aspiration passageway 38 with the contents of the chemical container via chemical flow tube 36 as shown in FIGS. 4–9. Valve 34 is constructed to define a cylindrical periphery for sliding engagement with the interior wall of bore 40. The valve outer periphery is divided by O-rings 64, 66, 68 shown in FIG. 10 which rest in circumferential grooves 63, 65, 67 shown in FIGS. 11 and 12. The O-rings divide the valve into a carrier fluid control segment 70, and an aspiration and vent control segment 72. The valve 34 is inserted into bore 40 so as to position the valve end 74 adjacent the washer 28 and open neck portion of container 22. Annular groove 76 near the end of the valve 34 snaps into annular ridge 78 circumscribing the inner wall of bore 40 near the end of depending sprayer neck portion 24. The length of valve 34 is selected and oriented so that when the annular ridge 78 is snapped into the annular groove 76, the valve 34 is functionally aligned relative to the carrier fluid constricted holes 52 and 54, and downstream aspiration passageway 38. The O-rings 64, 66, 68 engage the cylindrical wall of bore 40 so as to sealingly partition the carrier fluid control segment 70 within the bore and also sealingly partition the aspiration and vent segment 72 within the bore. The carrier fluid segment has formed therein a recessed area 79 which retains stopper member 80. Stopper member 80 sealingly engages the cylindrical wall of bore 40 as shown more particularly in FIG. 5, and when it is in registry with the first constricted passageway 52 by rotating valve 34 to its closed position, carrier fluid flow is prevented.

The aspiration and vent segment 72 define therein the aspiration duct 30 which includes a downwardly extending upstream section 82 which communicates with the container via the chemical flow tube 36, and a traverse downstream section 84 which opens into the outer peripheral surface of valve 34. When the traverse downstream section 84 of valve 34 is in registry with downstream aspiration passageway 38 in sprayer head 42, communication of the contents of container is possible at a flow rate which is controlled by constricted aspiration opening 86 and the carrier fluid pressure. The size of constricted opening 86 is preselected based on typical carrier fluid pressures to yield a desired mixing ratio of chemical to carrier fluid. The traverse section periphery defines a collar portion 88 of the outer cylindrical periphery of the valve 34 which sealingly engages the cylindrical wall of bore 40, whenever valve 34 is in a closed position.

The aspiration and vent segment 72 further defines therein vent duct 32 which communicates via opening 33 with counterbore 90 in the end of valve 34 and thereby the interior of the container 22. Vent duct 32 also communicates with transverse atmospheric vent port or passageway 92 in the downwardly depending sprayer neck portion 24 providing communication of the interior of container 22 with the atmosphere. The vent duct 32 periphery defines a collar portion 98 of the outer cylindrical periphery of valve 34 for sliding sealing engagement with the cylindrical interior wall of bore 40. The depending neck portion 24 has an axial hole 92 therethrough providing communication of bore 40 with the atmosphere. Communication of atmospheric pressure with the interior of container 22 is prevented by the engagement of vent collar portion 98 with the cylindrical wall of bore 40 when valve 34 is in a closed position.

The valve 34 is configured to provide full communication of vent duct 32 to atmospheric pressure through depending neck portion axial atmospheric vent port 92 simultaneously with registry of aspiration duct 30 with downstream aspiration passageway 38 simultaneously with registry of carrier fluid duct 62 with constricted holes 52 and 54. Plug 57 seals a small hole 59 in the bore wall which may result during the molding process due to placement of rod or pins in a typical manufacturing process but in no way is deemed a limitation of the invention.

Figure 3:
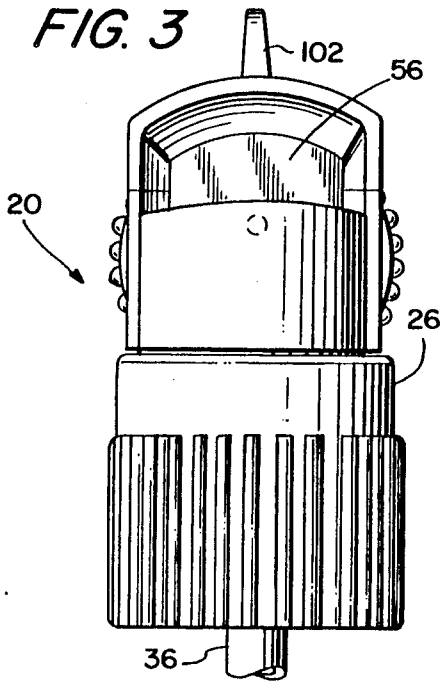
FIG. 3 is a front elevational view of the sprayer head assembly of FIG. 2.
Figure 2:
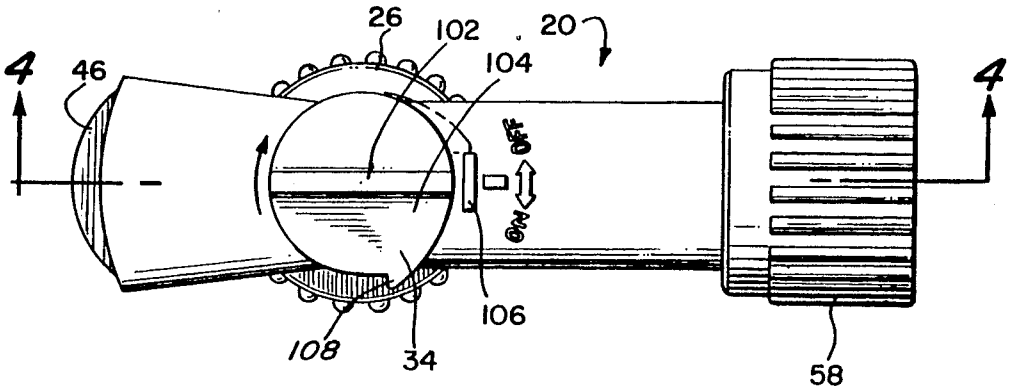
FIG. 2 is a top view of the sprayer head assembly of FIG. 1.
Figure 1:
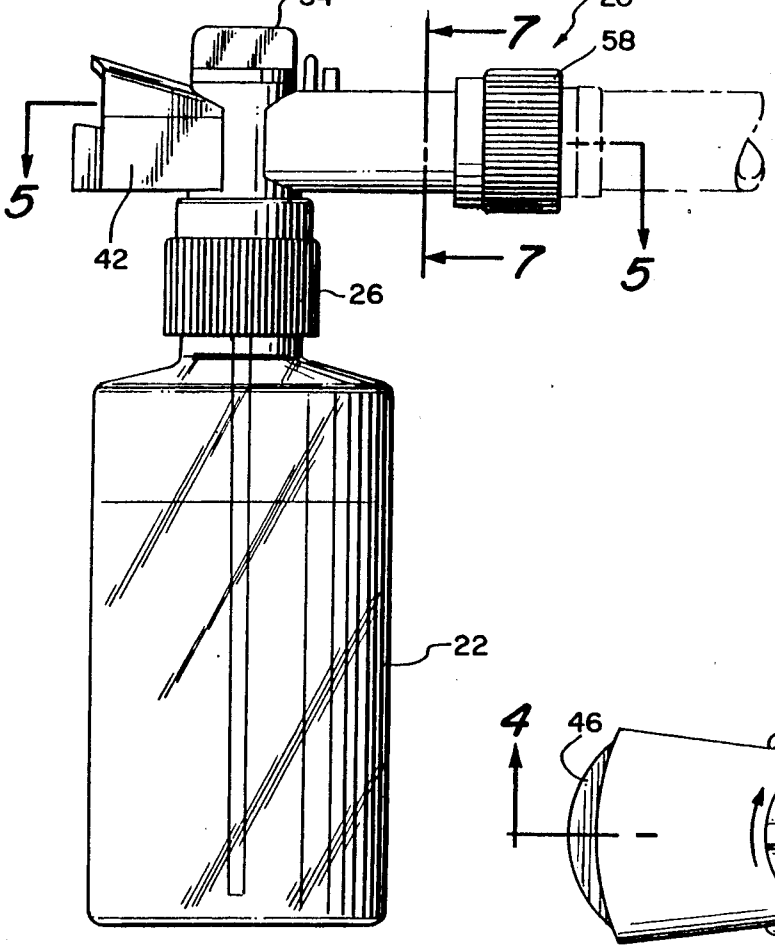
FIG. 1 is a side elevational view of a sprayer head assembly according to the principles of the invention.
Figure 4:
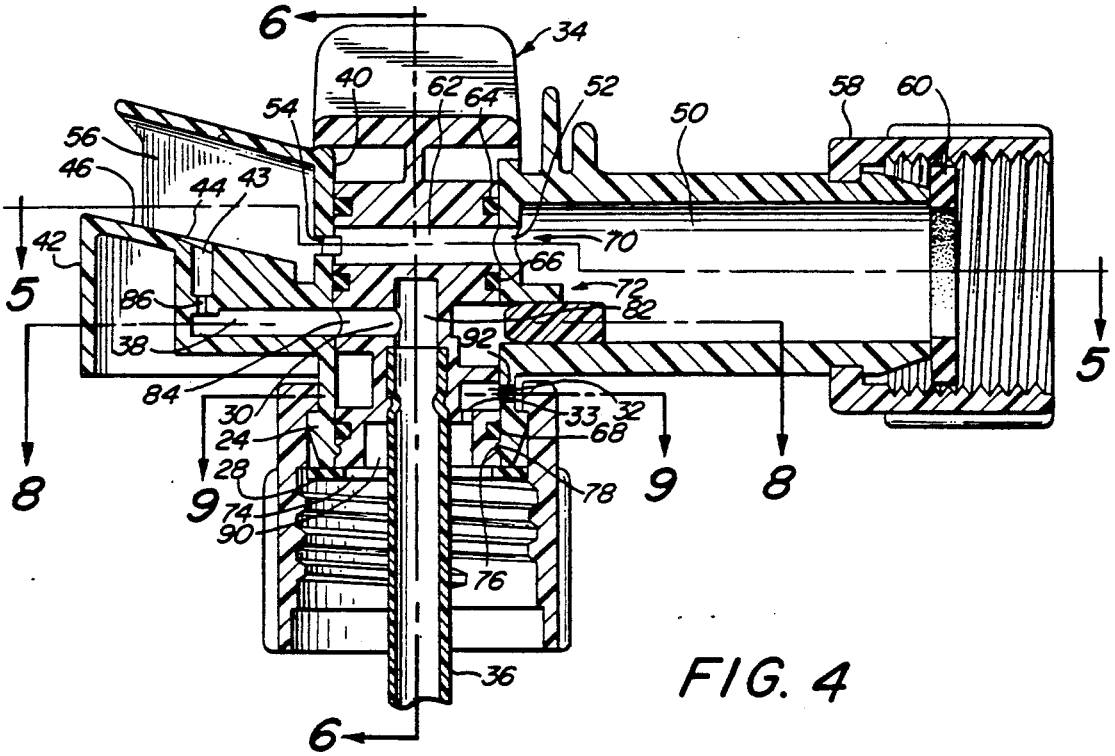
FIG. 4 is a sectional view taken along line 4—4 of FIG. 2.
Figure 5:
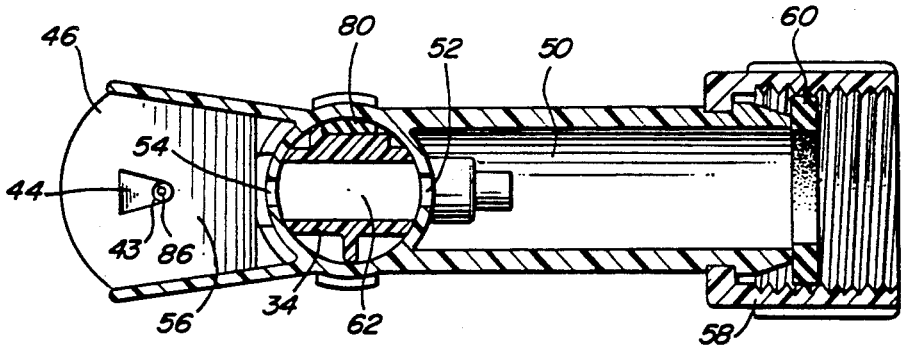
FIG. 5 is a sectional view taken along line 5—5 of FIG. 2.

In operation, when the valve 34 is rotated in the open position by turning wing 102 on valve cap 104, a stream of pressurized fluid is discharged through the second constricted hole 54 into the hooded or expansion chamber 56 resulting in a zone of reduced pressure outside the graduated recess 44. As shown in FIG. 4 if the valve is open, the suction created by the low pressure in expansion chamber draws the chemical solution in the container through chemical flow tube 36, aspiration passageways 82, 84, 86 and 43 and into the stream of the carrier fluid. Venting is provided through vent duct 32 and atmospheric vent port 92. The sprayer nozzle valve arrangement can conveniently be operated with one hand while the sprayer nozzle, chemical container and water hose can be controlled with the other thereby providing a safe spray operation. A tab 108 on valve cap 104 locks behind upwardly extending tab 106 securing valve 34 in a closed position when the sprayer is not in use.

Although the dispensing closure may be made of any suitable material, flexible synthetic plastic material is preferred such as polyethylene which is particular suitable for constructing the sprayer head assembly 20 since it is resilient yet durable. However, any other material which is resistant to and compatible with the chemical fluid to be sprayed or other matter to be held in the container may also be used as a material for manufacturing the sprayer head assembly. The stopper member 80 is preferably made of a soft plastic elastimer material or other suitable synthetic rubber material. Such material provides an effective seal with the bore surface which is typically made of a harder synthetic plastic material.

The above-described detailed description of a preferred embodiment described the best mode contemplated by the inventors for carrying out the present invention at the time this application was filed and is offered by way of example and not by way of limitation. Accordingly, various modification may be made to the above-described preferred embodiment without departing from the scope of the invention. Accordingly, it should be understood that although the invention has been described and shown for a particular embodiment, nevertheless various changes and modification obvious to a person of ordinary skill in the art to which the invention pertains are deemed to lie within the spirit and scope of the invention as set forth in the following claims.

We claim:

1. An aspiration-type chemical sprayer, comprising:

a container having an interior for storing a chemical to be sprayed;

a sprayer head assembly defining an outlet means and having inlet carrier fluid passageway means for directing a pressurized flow of carrier fluid into said outlet means;

connection means for mounting said sprayer head to said container;

said sprayer head assembly further defining an aspiration passageway for communication between said container interior and said outlet means, and a vent port for communication of atmospheric pressure with said container interior;

a valve moveably positioned within said sprayer head assembly so as to simultaneously intersect said inlet passageway, aspiration passageway and said vent port;

said valve having integrally formed thereto inlet carrier fluid duct channeling means, aspiration duct channeling means and vent duct channeling means, for controlling simultaneous communication through said inlet passageway means, aspiration and vent passageways; and said valve further having inlet passageway closure means, aspiration passageway closure means and vent passageway closure means for providing simultaneous closing of said passageways.

2. The apparatus defined in claim 1 wherein said connection means comprises a rotatable coupler which sealably mounts the sprayer head to said container.

3. The apparatus defined in claim 1 wherein said spray head assembly includes an interior surface defining a bore for receiving and engaging said valve.

4. The apparatus defined in claim 3 wherein said valve is rotatably positioned within said bore.

5. The apparatus defined in claim 4 wherein said inlet passageway closure means comprises a stopper member on said valve for sealing engagement with the bore surface when said valve is positioned in a closed position.

6. The apparatus defined in claim 4 wherein said aspiration and vent passageways closure means in said valve each include a surrounding collar for a sealing engagement with the bore surface when said valve is positioned in a closed position.

7. The apparatus defined in claim 4 wherein said bore aspiration passageway includes a constricted passageway of predetermined size for controlling flow of a chemical stored in said container.

8. The apparatus defined in claim 7 wherein said valve and bore include locating means for positioning said valve within said bore.

9. The apparatus defined in claim 7 wherein said valve includes three O-rings positioned to sealingly partition said inlet passageway from said aspiration and vent passageways.

10. An aspiration-type chemical sprayer comprising:

a container having an interior for storing a chemical to be sprayed;

a sprayer head having an expansion chamber, a carrier fluid inlet chamber for directing a pressurized flow of carrier liquid into the expansion chamber, an aspiration passageway for directing chemicals from the container interior to the expansion chamber and an atmospheric vent port for communication of atmospheric pressure with the container interior;

connection means for mounting the sprayer head to the container;

a chemical flow tube in fluid communication with the chemical stored in the container; and a valve member moveably positioned within the sprayer head and being constructed and arranged to simultaneously connect:

(a) the carrier fluid inlet chamber to the expansion chamber;

(b) the chemical flow tube to the aspiration passageway;

(c) the vent port to the interior of the container in one position and to simultaneously disconnect;

(d) the carrier fluid inlet chamber from the expansion chamber;

(e) the chemical flow tube from the aspiration passageway; and (f) the vent port from the interior of the container in another closed position.

11. The sprayer of claim 10 wherein the valve member is rotatably mounted within the sprayer head so that in one rotational position the valve member is open to allow carrier fluid to educt chemical from the container and in another rotational position the valve member is closed.

12. The sprayer of claim 10 wherein the valve member has integrally formed therein:

(a) a carrier fluid duct for connecting the carrier fluid inlet chamber to the expansion chamber;

(b) an aspiration duct for connecting the chemical flow tube to the aspiration passageway; and (c) an atmospheric duct for connecting the vent port to the interior of the container when the valve member is in the open position.

13. The sprayer of claim 12 wherein the valve member further has integrally formed therein:

(a) a carrier fluid inlet chamber closure means for disconnecting the carrier fluid inlet chamber from the expansion chamber;

(b) an aspiration passageway closure means for disconnecting the aspiration duct from the aspiration passageway; and (c) a vent port closure means for disconnecting the vent duct from the vent port atmospheric when the valve member is in the closed position.

14. The sprayer of claim 13 wherein the valve member includes a fluid sealing means individually associated with each of the carrier fluid inlet chamber closure means, the aspiration passageway closure means and the vent port closure means for sealing the carrier fluid inlet chamber, the aspiration passageway and the vent port, respectively, when the valve member is in the closed position.

15. The sprayer of claim 14 wherein the carrier fluid passageway in the valve member comprises a straight through bore aligned at right angles to the rotational axis of the valve member.

16. The sprayer of claim 15 wherein the aspiration and atmospheric passageways in the valve member each comprise one bore aligned parallel to the rotational axis of the valve member and a lateral bore, the lateral bore being aligned with the aspiration and vent passageways in the sprayer head, respectively, when the valve member is in the open position.

* * * * *